US010332736B2

(12) United States Patent
Yoshinari et al.

(10) Patent No.: US 10,332,736 B2
(45) Date of Patent: Jun. 25, 2019

(54) MASS SPECTROMETER WITH ION FREQUENCY SELECTION

(71) Applicant: Hitachi High-Technologies Corporation, Tokyo (JP)

(72) Inventors: Kiyomi Yoshinari, Tokyo (JP); Yasushi Terui, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 383 days.

(21) Appl. No.: 14/773,902

(22) PCT Filed: Jan. 24, 2014

(86) PCT No.: PCT/JP2014/051523
§ 371 (c)(1),
(2) Date: Sep. 9, 2015

(87) PCT Pub. No.: WO2014/141756
PCT Pub. Date: Sep. 18, 2014

(65) Prior Publication Data

US 2016/0020082 A1 Jan. 21, 2016

(30) Foreign Application Priority Data

Mar. 11, 2013 (JP) ..... 2013-048263

(51) Int. Cl.
*H01J 49/00* (2006.01)
*H01J 49/04* (2006.01)
*H01J 49/42* (2006.01)

(52) U.S. Cl.
CPC ..... *H01J 49/426* (2013.01); *H01J 49/0031* (2013.01); *H01J 49/0422* (2013.01);
(Continued)

(58) Field of Classification Search
CPC .. H01J 49/426; H01J 49/0422; H01J 49/0431; H01J 49/0031; H01J 49/429; H01J 49/4215; H01J 49/4225
See application file for complete search history.

(56) References Cited

U.S. PATENT DOCUMENTS 5,089,703 A 2/1992 Schoen et al.
6,753,523 B1 * 6/2004 Whitehouse ..... H01J 49/005 250/292

(Continued)

FOREIGN PATENT DOCUMENTS

CN 103069540 A 4/2013
EP 2602809 A1 6/2013

(Continued)

OTHER PUBLICATIONS

International Search Report of PCT/JP2014/051523.
German Office Action received in corresponding German Application No. 11 2014 000 859.1 dated Mar. 2, 2017.

*Primary Examiner* — Brooke J Purinton
(74) *Attorney, Agent, or Firm* — Mattingly & Malur, PC

(57) ABSTRACT

An object of the invention is to provide a mass spectrometer system capable of obtaining a mass spectrum with high resolution as the mass number of an ion becomes higher. In the mass spectrometer system of the invention, a control unit 8 controls a mass spectrometry unit 4 so that a direct current voltage U, an amplitude V of a radio-frequency voltage, and a frequency F of the radio-frequency voltage, which are applied to a quadrupole electrode 13, are increased as a mass-to-charge ratio m/z of an ion of a target for mass spectrometry becomes larger. By controlling in this manner, the ion frequency when the ion passes through the inside of the mass spectrometry unit 4 is increased as the mass number of an ion becomes higher, and therefore, it is possible to obtain the mass spectrum with higher resolution.

17 Claims, 14 Drawing Sheets

(52) U.S. Cl.
CPC ..... *H01J 49/0431* (2013.01); *H01J 49/429* (2013.01); *H01J 49/4215* (2013.01); *H01J 49/4225* (2013.01)

(56) References Cited

U.S. PATENT DOCUMENTS

| | | | | |
|---|---|---|---|---|
| 2004/0149903 | A1* | 8/2004 | Wang | H01J 49/424 250/292 |
| 2006/0124845 | A1* | 6/2006 | Makarov | G01N 27/62 250/282 |
| 2007/0295900 | A1* | 12/2007 | Konenkov | H01J 49/4215 250/283 |
| 2008/0121795 | A1 | 5/2008 | Sugiyama et al. | |
| 2009/0014637 | A1* | 1/2009 | Giles | H01J 49/4275 250/281 |
| 2009/0302215 | A1* | 12/2009 | Guna | H01J 49/0031 250/283 |
| 2013/0200261 | A1 | 8/2013 | Mizutani et al. | |
| 2014/0252220 | A1* | 9/2014 | Rafferty | H01J 49/0031 250/282 |

FOREIGN PATENT DOCUMENTS

| | | | |
|---|---|---|---|
| JP | 2000-077025 | A | 3/2000 |
| JP | 2000-323090 | A | 11/2000 |
| JP | 2002-175774 | A | 6/2002 |
| JP | 2008-130469 | A | 6/2008 |
| WO | 2012/017548 | A1 | 2/2012 |

* cited by examiner

[Fig. 1]
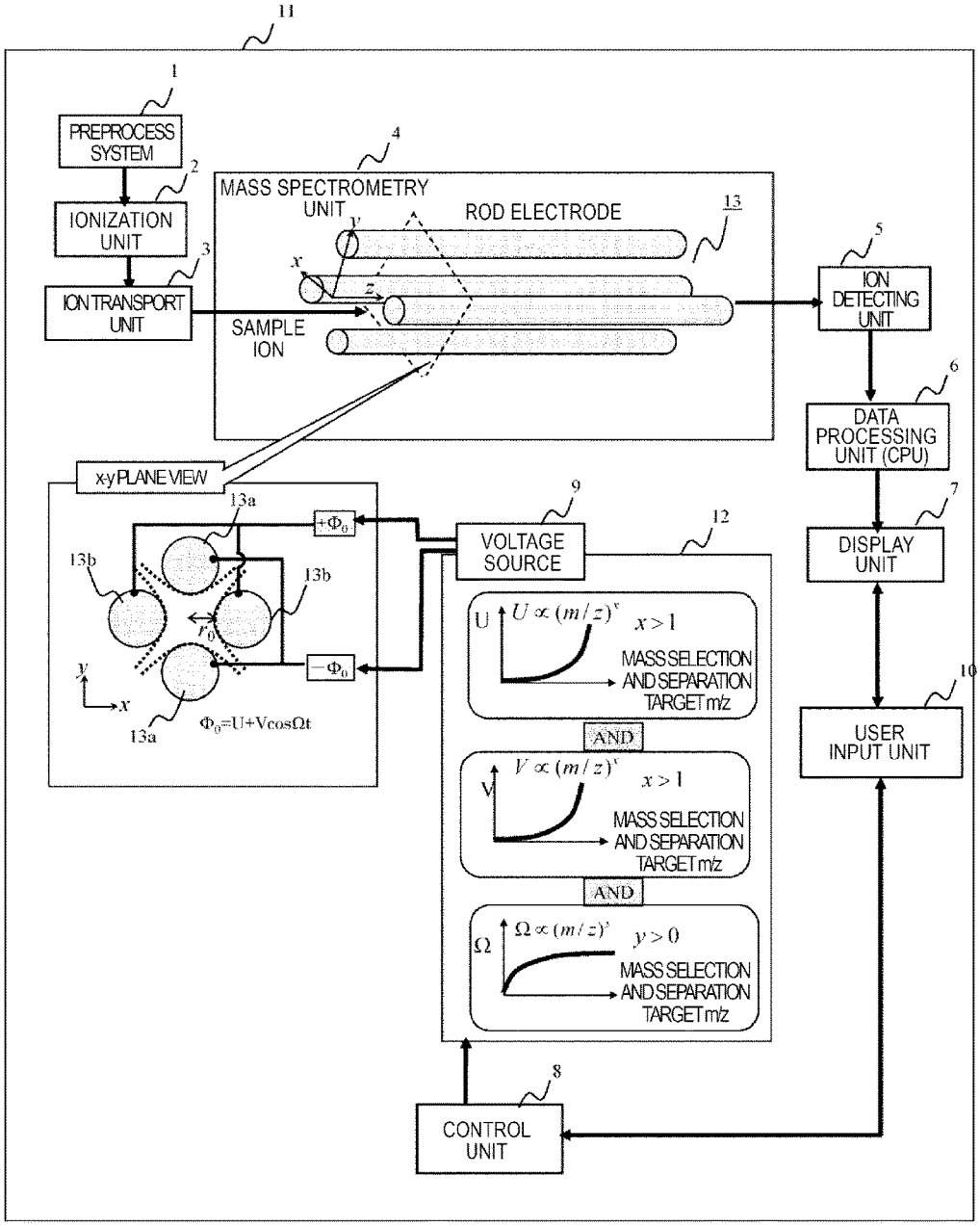

[Fig. 2]
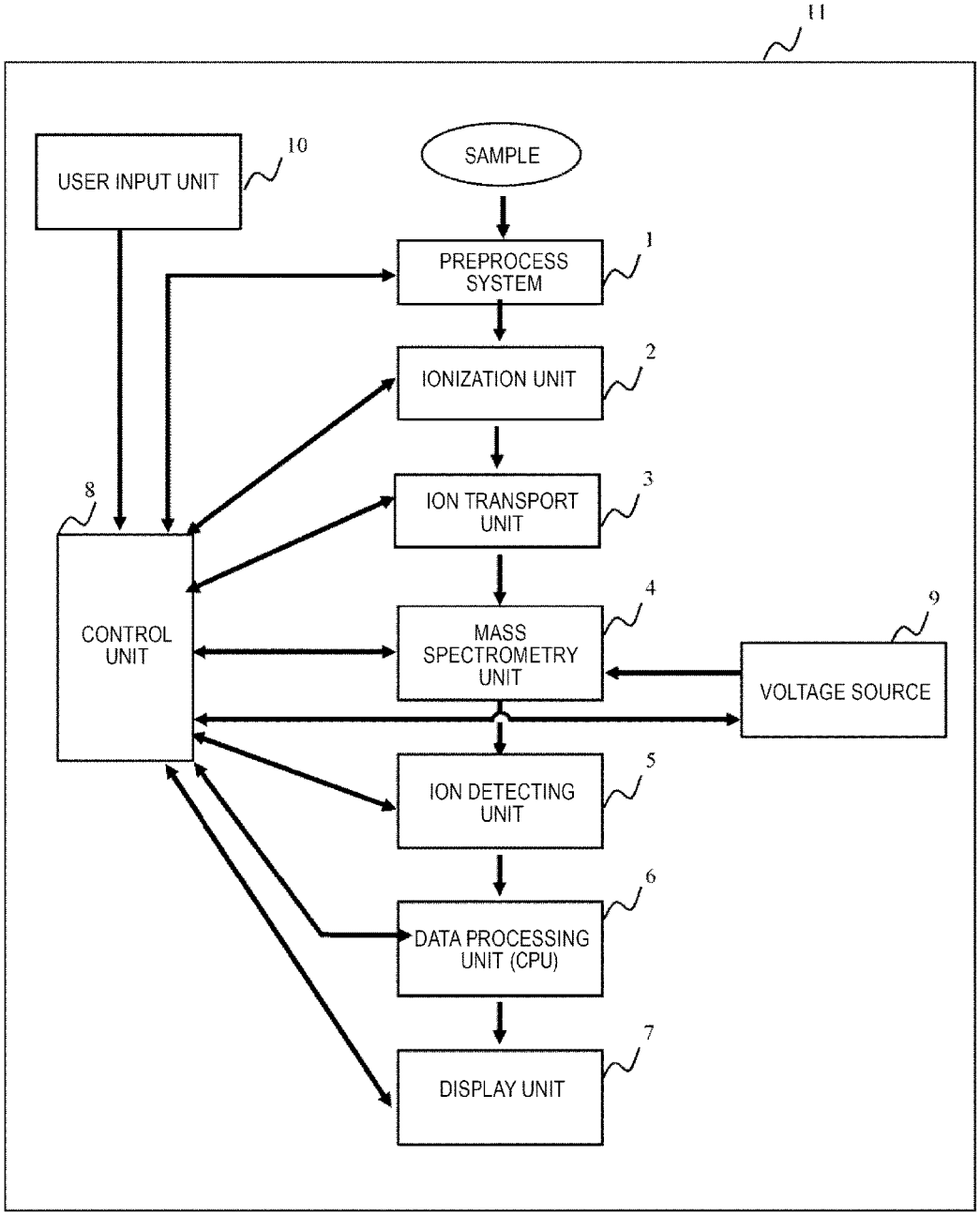

[Fig. 3]
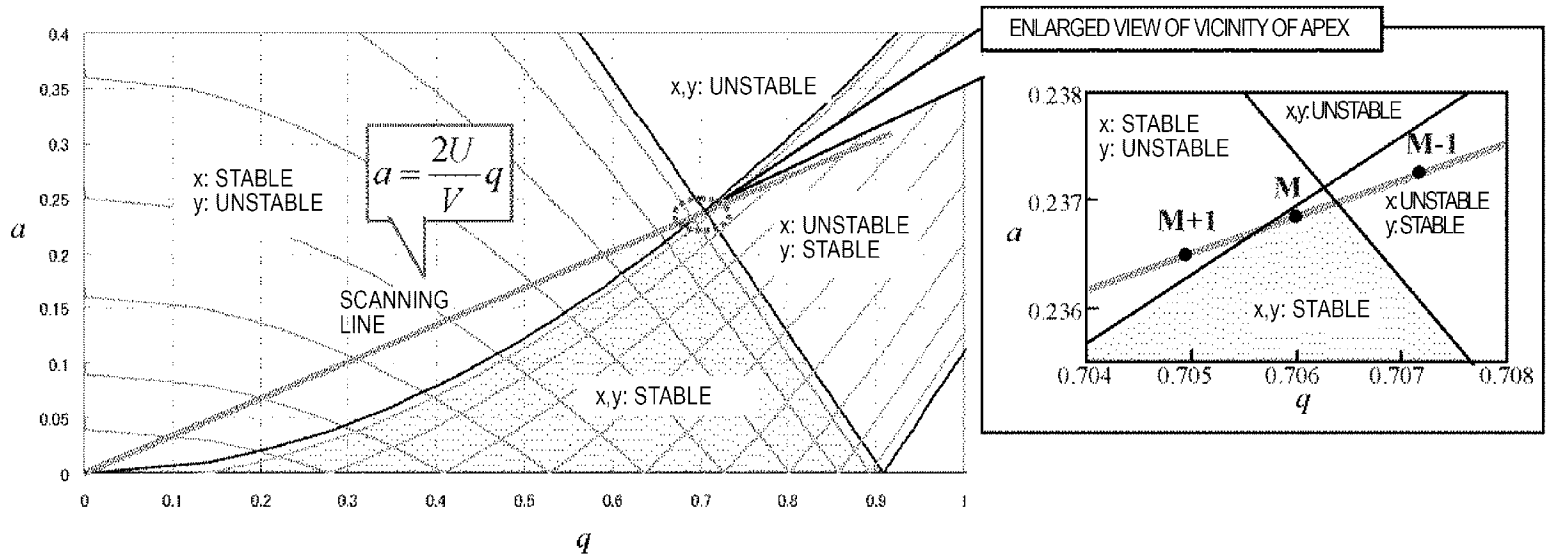

[Fig. 4]
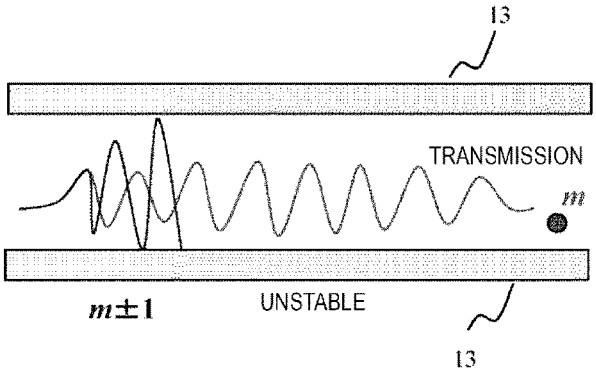
[Fig. 5]
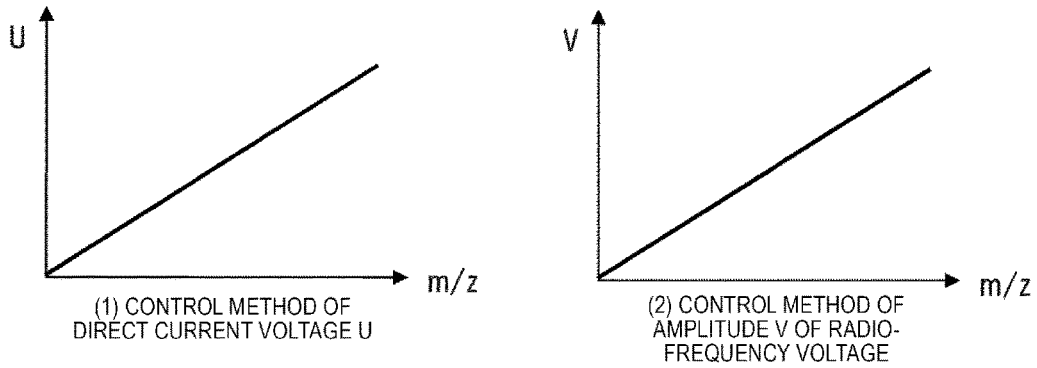

[Fig. 6]
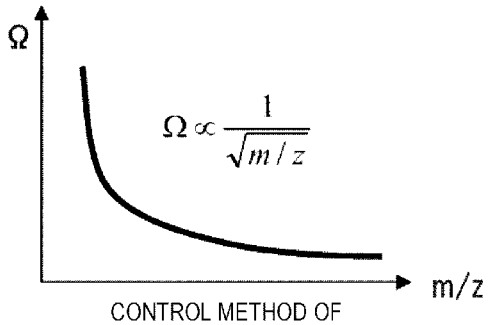
CONTROL METHOD OF ANGULAR FREQUENCY Ω OF RADIO-FREQUENCY VOLTAGE
[Fig. 7]
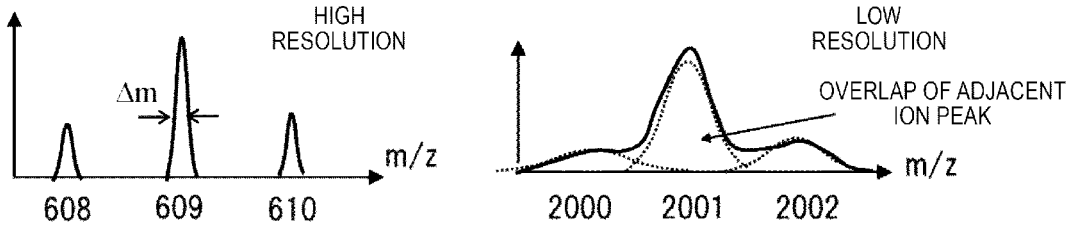
(1) MASS SPECTRUM OF LOW MASS NUMBER ION
(2) MASS SPECTRUM OF HIGH MASS NUMBER ION

[Fig. 8]
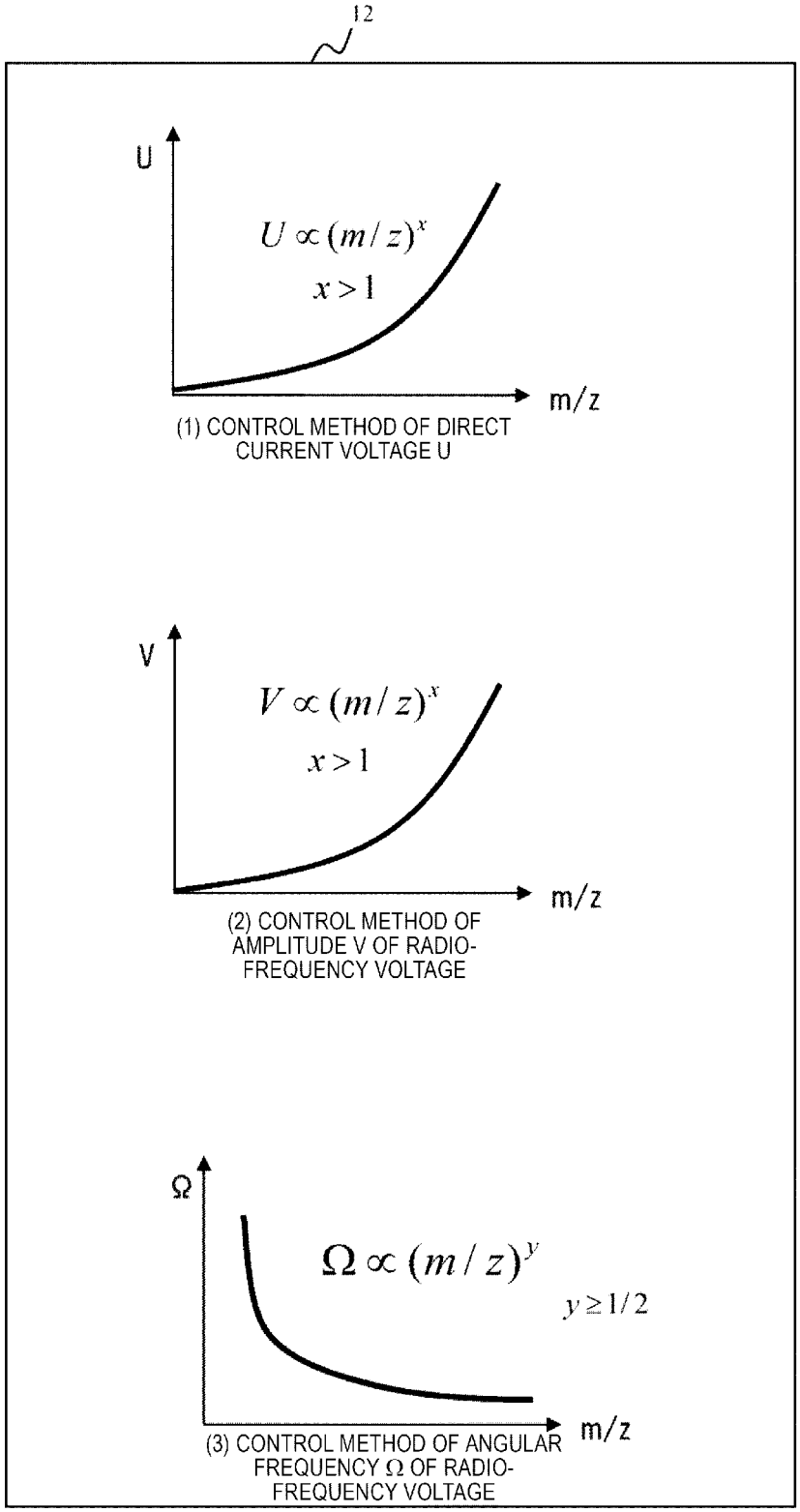

[Fig. 9]
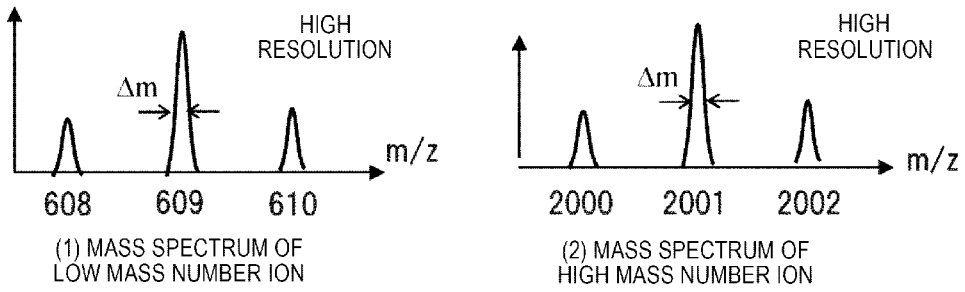

[Fig. 10]
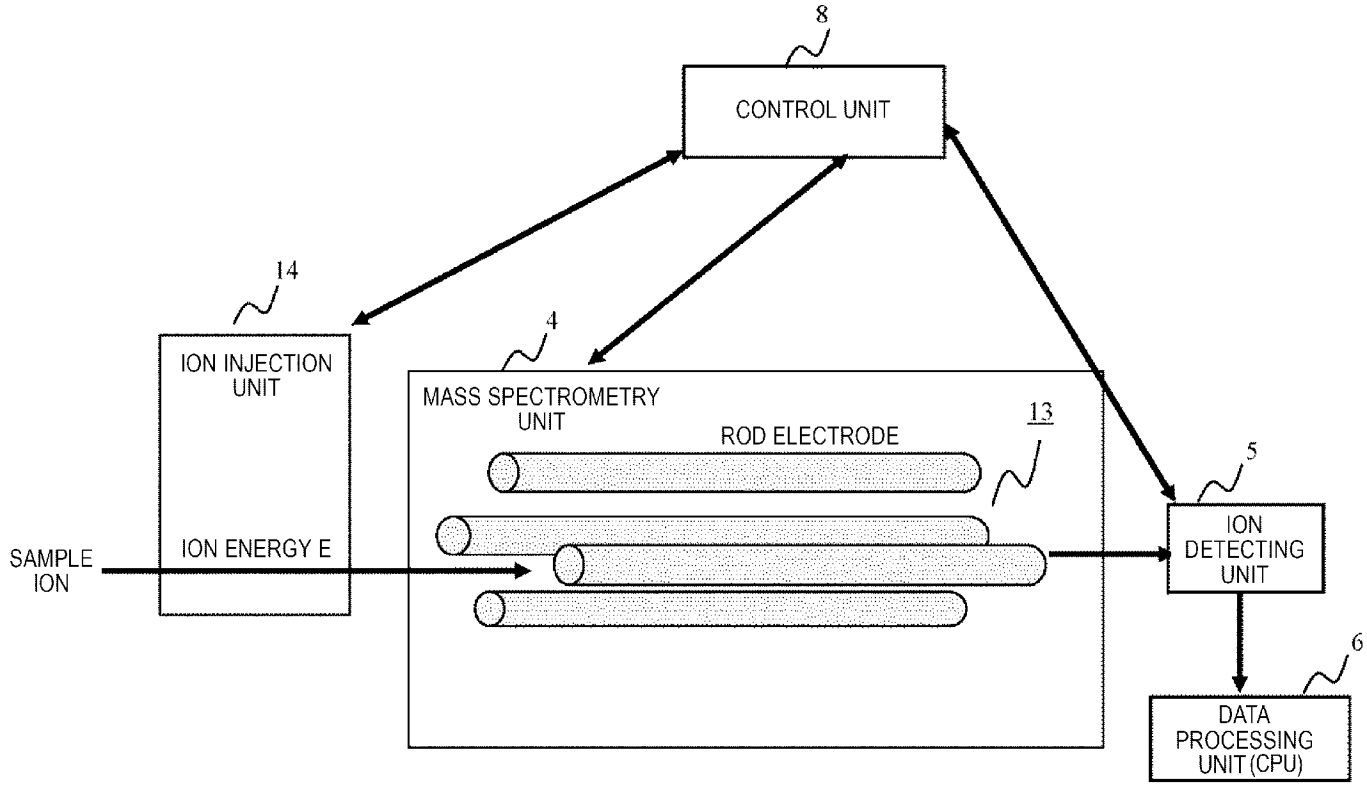

[Fig. 11A]
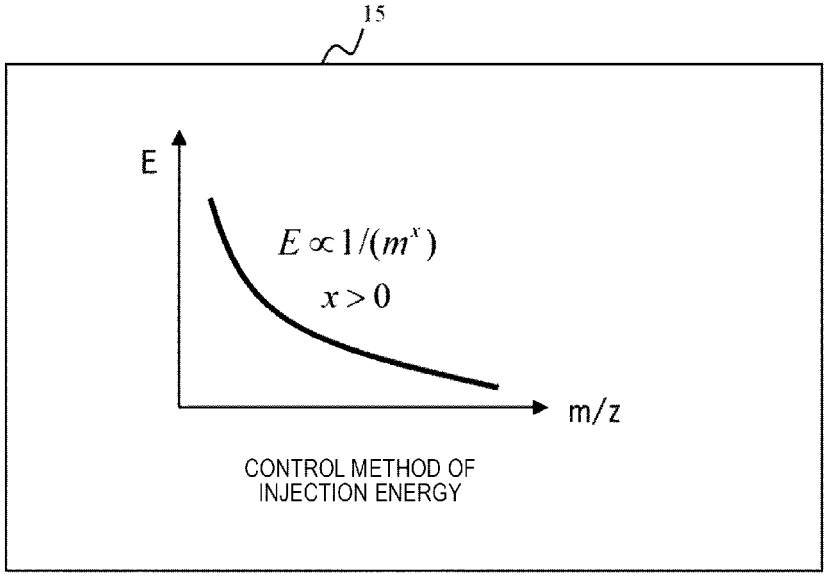
[Fig. 11B]
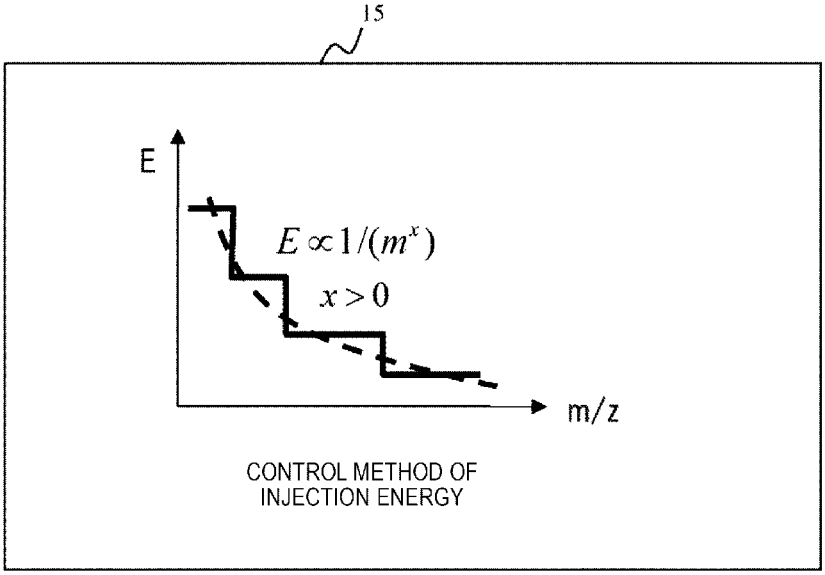

[Fig. 12]
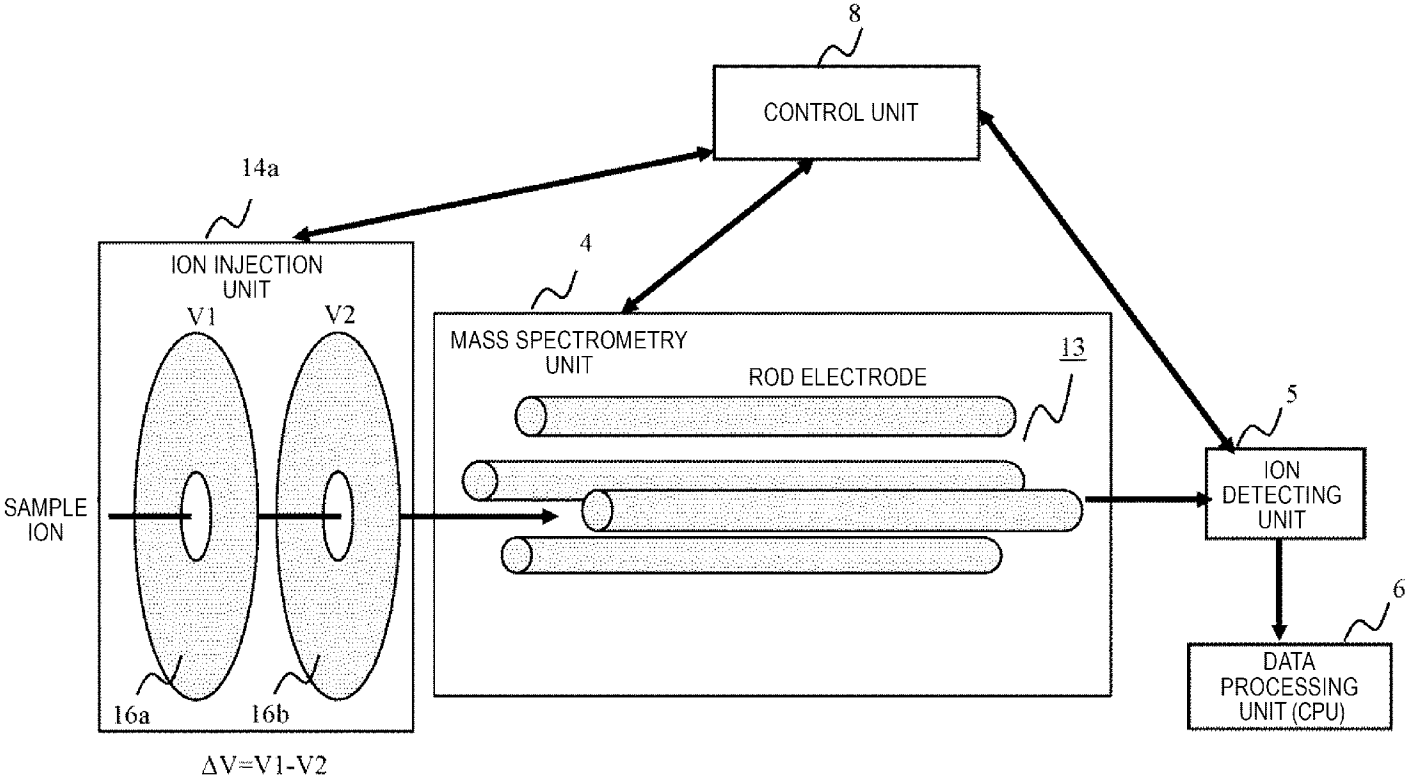

[Fig. 13A]
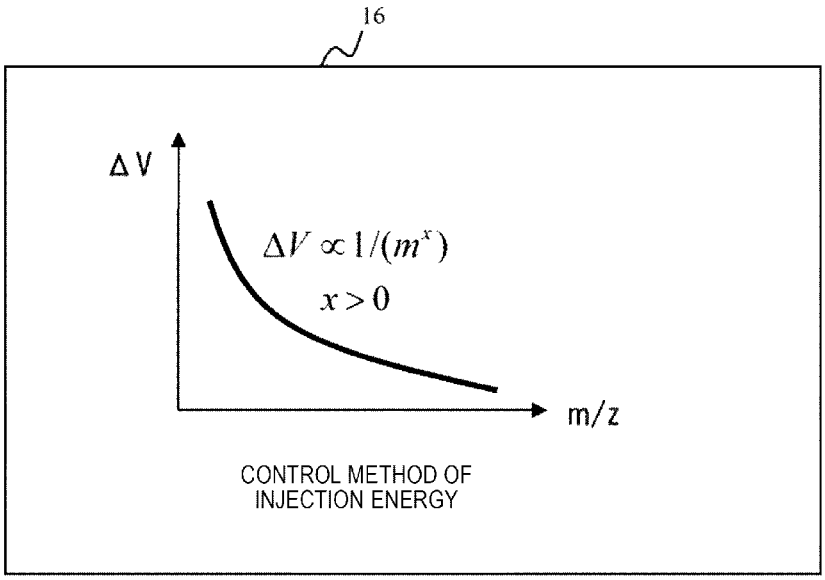
[Fig. 13B]
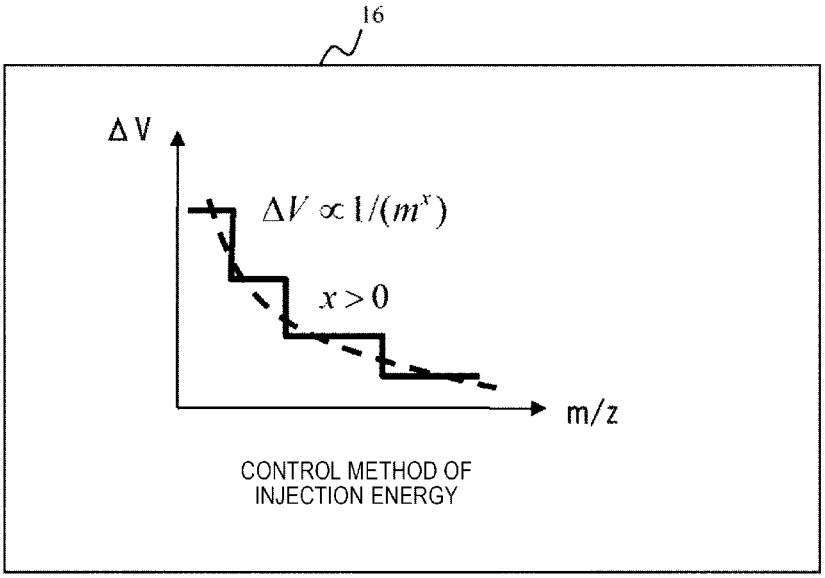

[Fig. 14]
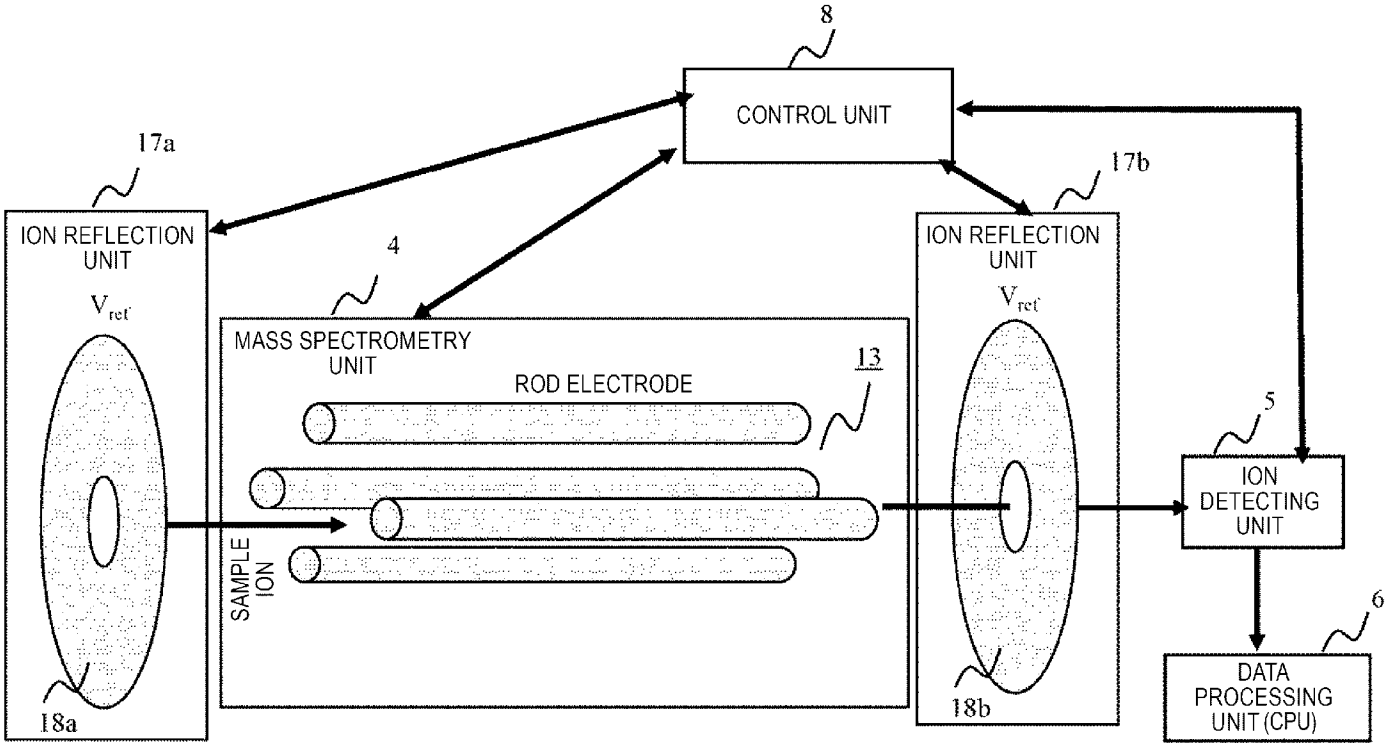

[Fig. 15]
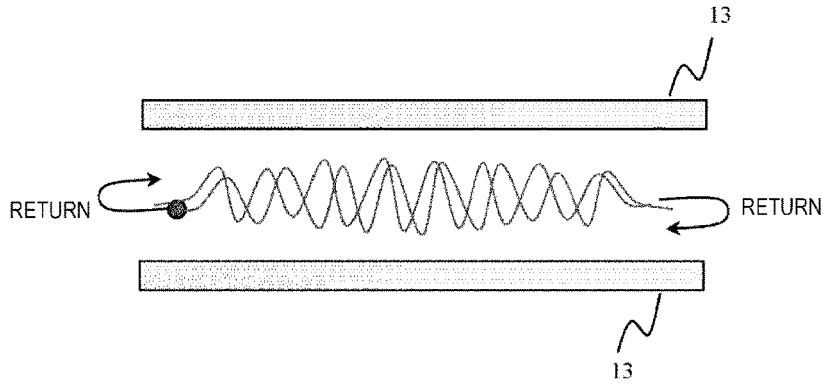
[Fig. 16]
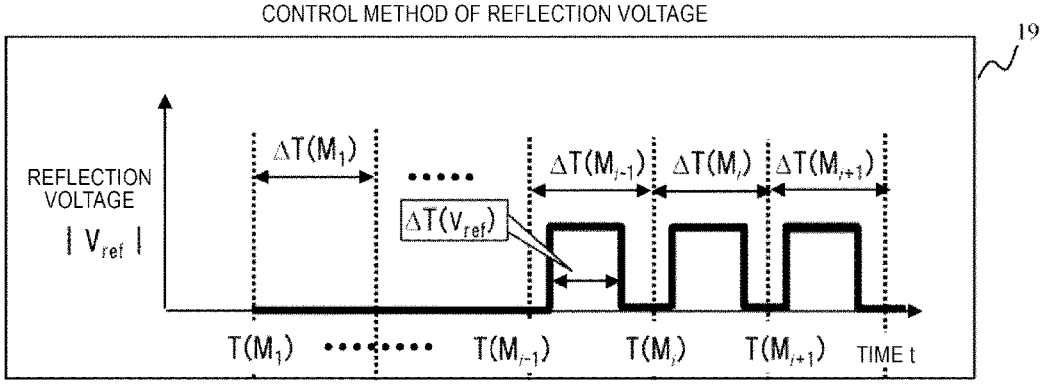
[Fig. 17]
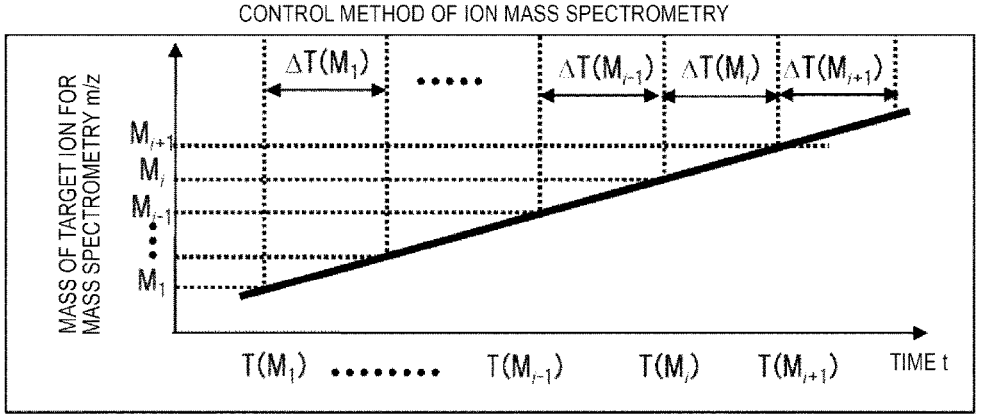

[Fig. 18]
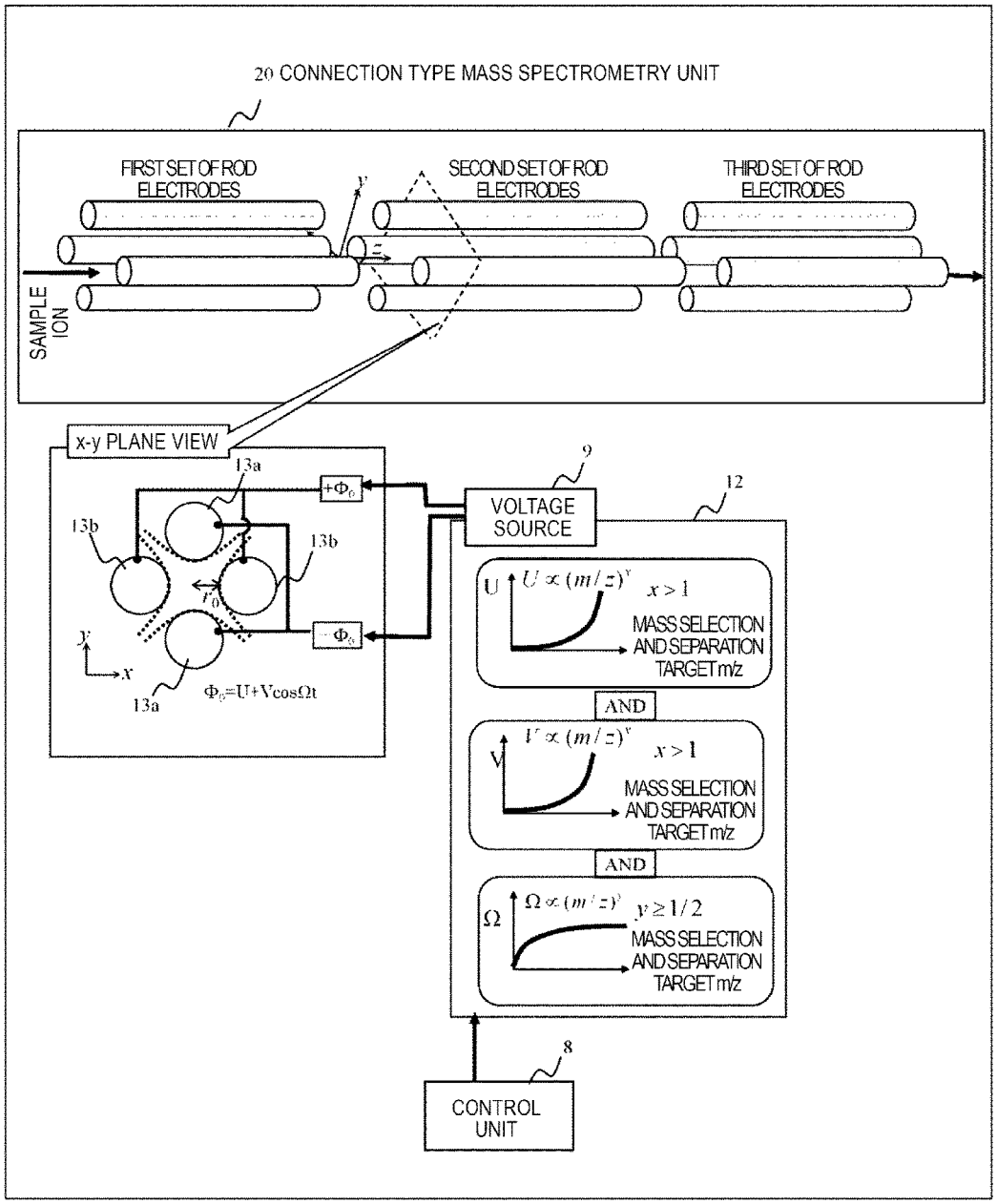

MASS SPECTROMETER WITH ION FREQUENCY SELECTION

TECHNICAL FIELD

The present invention relates to a mass spectrometer system, and particularly to a mass spectrometric technique for performing quantitative analysis with high resolution and sensitivity in a wide mass-to-charge ratio range.

BACKGROUND ART

In general mass spectrometry, as a method of scanning a mass-to-charge ratio m/z of a mass selection-separation target, the following two types are mainly exemplified. Here, m is ion mass, and z is a charge number of an ion. A first type is a method of controlling values of a direct current voltage U and amplitude V of a radio-frequency voltage (RF voltage), which are applied to four or more rod electrodes, to be proportional to a mass-to-charge ratio m/z of a mass selection-separation target. A second type is a method of controlling a value of an angular frequency Ω of the radio-frequency voltage (RF voltage), which is applied to four or more rod electrodes, to be proportional to $1/\sqrt{m/z}$. As the latter method, a method of controlling the radio-frequency voltage (RF voltage) to be a high frequency when an ion has low mass number and to be a low frequency when an ion has high mass number is disclosed in PTL 1.

CITATION LIST

Patent Literature

PTL 1: JP-A-2002-175774

SUMMARY OF INVENTION

Technical Problem

In a case where an analysis, in particular, a quantitative analysis, is performed on the component in a sample by scanning the mass-to-charge ratio m/z of the mass selection-separation target, and by outputting the number of detections of ions (mass spectrum) for each mass-to-charge ratio m/z, in the mass spectrum, high separability (resolution) from the mass peak of adjacent ion species is required. In the related art, when mass spectrometry is performed in the wide mass-to-charge ratio m/z range, there is a tendency that, as the m/z value of the ion species becomes lower (low mass ion), the separability (resolution) from the mass peak of adjacent ion species is high, and as the m/z value of the ion species becomes higher (high mass ion), the mass peak thereof overlaps the mass peak of the adjacent ion, thereby degrading the resolution.

An object of the invention is to solve the problem described above and to provide a mass spectrometer system and a method which can perform quantitative analysis for an ion species having a high m/z value (high mass ion) with high resolution and sensitivity.

Solution to Problem

In order to achieve the object described above, in the invention, there is provided a mass spectrometer system, including: a mass spectrometry unit that performs mass selection and separation of an ion species having a specific mass-to-charge ratio m/z by applying a direct current voltage U and a radio-frequency voltage V cos Ωt to a multipole electrode to generate a multipole electric field, injecting an ionized sample therein, and adjusting and controlling the voltage applied to the multipole electrode so that the ion species having a specific mass-to-charge ratio m/z passes through the multipole electrode; an ion detecting unit that detects the ion species; a data processing unit that processes an output of the ion detecting unit; and a control unit that controls the mass spectrometry unit, in which the control unit controls the mass spectrometry unit such that an ion frequency of the ion species is increased in proportion to the value of the mass-to-charge ratio m/z of the ion species allowed to pass through the multipole electrode.

In addition, in order to achieve the object described above, in the invention, there is provided a mass spectrometry method using a mass spectrometry unit, the method including: controlling the mass spectrometry unit so that mass selection and separation of an ion species having a specific mass-to-charge ratio m/z is performed by applying a direct current voltage and a radio-frequency voltage to a multipole electrode of the mass spectrometry unit to generate a multipole electric field, injecting an ionized sample thereinto, and adjusting and controlling the voltage applied to the multipole electrode so that the ion species having a specific mass-to-charge ratio m/z passes through the multipole electrode, and when the ion species is detected, an ion frequency of the ion species is increased in proportion to the value of the mass-to-charge ratio m/z of the ion species allowed to pass through the multipole electrode.

Advantageous Effects of Invention

According to the invention, as the mass number of an ion becomes higher, which requires a resolution, the number of vibrations when the ion passes through the multipole electrode is controlled to be increased, and therefore, it is possible to perform mass spectrometry while maintaining the resolution when the mass number of an ion is high.

BRIEF DESCRIPTION OF DRAWINGS

FIG. 1 is a schematic diagram of a control method of mass spectrometry according to a first embodiment.

FIG. 2 is a schematic diagram illustrating an entire mass spectrometer system, which measures mass spectrometry data, according to the first embodiment.

FIG. 3 is a diagram illustrating a stable transmission region of an ion in a quadrupole field according to the first embodiment.

FIG. 4 is a conceptual diagram according to the first embodiment when an ion stably passes through or is unstably emitted from four or more rod electrodes.

FIG. 5 is a conceptual diagram illustrating a general control method of a direct current voltage U, and an amplitude V of a radio-frequency voltage according to the first embodiment.

FIG. 6 is a conceptual diagram illustrating a general control method of an angular frequency Ω of the radio-frequency voltage according to the first embodiment.

FIG. 7 is a conceptual diagram illustrating a mass spectrum, which is obtained by using the general control method, according to the first embodiment.

FIG. 8 is a conceptual diagram illustrating a control method of the direct current voltage U, the amplitude V of the radio-frequency voltage, and the angular frequency Ω of the radio-frequency voltage according to the first embodiment.

FIG. 9 is a conceptual diagram illustrating a mass spectrum, which is obtained in the first embodiment.

FIG. 10 is a schematic diagram illustrating a control method of ion injection energy and a mass spectrometer system thereof according to a second embodiment.

FIG. 11A is a conceptual diagram illustrating the control method of injection energy according to the second embodiment.

FIG. 11B is another conceptual diagram illustrating the control method of injection energy according to the second embodiment.

FIG. 12 is a schematic diagram illustrating the mass spectrometer system according to the second embodiment when an injection electrode is used as the control method of ion injection energy.

FIG. 13A is a conceptual diagram illustrating a control method of an injection voltage applied to the injection electrode according to the second embodiment.

FIG. 13B is another conceptual diagram illustrating the control method of the injection voltage applied to the injection electrode according to the second embodiment.

FIG. 14 is a schematic diagram illustrating a mass spectrometer system in which an ion reflecting unit is provided according to a third embodiment.

FIG. 15 is a conceptual diagram illustrating an ion passing through rod electrodes by being reflected according to the third embodiment.

FIG. 16 is a conceptual diagram illustrating a general control method for a method of applying a reflection voltage and a mass spectrometry scanning method according to the third embodiment.

FIG. 17 is a conceptual diagram illustrating a general control method for the method of applying a reflection voltage and the mass spectrometry scanning method according to the third embodiment.

FIG. 18 is a conceptual diagram illustrating a tandem mass spectrometer, which includes a control method of the invention, according to a fourth embodiment.

DESCRIPTION OF EMBODIMENTS

Hereinafter, various embodiments of the invention will be described with reference to the drawings. In addition, in the present specification, an ion frequency means the number of vibrations when anion species passes through the multipole electrode. In the invention, the ion frequency, which is the number of vibrations of the ion species passing through the multipole electrode, of the ion species having a high m/z value (high mass ion) is increased. As preferable forms thereof, there are the following forms (i) to (iii).

(i) When a mass-to-charge ratio m/z of a mass selection-separation target is increased to be scanned with respect to a voltage applied to the multipole electrode, values of a direct current voltage U, an amplitude V of the radio-frequency voltage, and an angular frequency Ω of the radio-frequency voltage, which are applied to the multipole electrode, are controlled to be increased at the same time.

(ii) Injection energy E when an ionized sample is injected into the multipole electrode is controlled so that the injection energy E is decreased as the value of the mass-to-charge ratio m/z of the mass selection-separation target ion becomes larger, and the injection energy E is increased as the value of the mass-to-charge ratio m/z of the mass selection-separation target ion becomes smaller.

(iii) An ion having a high m/z value that is equal to or greater than a specific mass-to-charge ratio is controlled so that a voltage for reflecting the ion is applied to an ion reflecting unit, which is provided at an end opposite to an end where the ion is injected into the multipole electrode, and the ion species is reflected without being emitted from the multipole electrode to pass through the multipole electrode again. Hereinafter, various embodiments are sequentially described.

First Embodiment

A mass spectrometer system and a spectrometry method according to a first embodiment will be described with reference to FIGS. 1 to 9.

FIG. 1 is a diagram illustrating a control method of an application voltage of a mass spectrometry unit, which is a characteristic of a mass spectrometer system according to the first embodiment. FIG. 2 is a configuration diagram illustrating the entire mass spectrometer system according to the first embodiment.

First, FIG. 1 illustrates a spectrometry flow of a mass spectrometer system 11. A target sample for mass spectrometry of the mass spectrometer system 11 is temporally separated and fragmented by gas chromatography (GC) or liquid chromatography (LC) that configures a preprocess system 1. In addition, the sample ions that are sequentially ionized by an ionization unit 2 are injected into a mass spectrometry unit 4 through an ion transport unit 3 to be mass-separated.

A voltage is applied to a mass spectrometry unit 4 via a voltage source 9 while being controlled by a control unit 8. The separated ion is detected by an ion detecting unit 5, a data processing unit 6 performs data reduction and processing, and mass spectrometry data 1 as a spectrometry result of the data reduction and processing is displayed on a display unit 7.

As illustrated in the mass spectrometer system 11 of FIG. 2, the control unit 8 controls a series of entire mass spectrometry processes of ionization of the sample and transportation of the sample ion beam to the mass spectrometry unit 4 by the preprocess system 1, the ionization unit 2, and the ion transport unit 3; the voltage source 9; injection in the mass spectrometry unit 4; a mass separation process; ion detection, data processing, data display by the ion detecting unit 5, the data processing unit 6, the display unit 7; and an instruction process by a user input unit 10.

Here, the mass spectrometry unit 4 is a quadrupole mass spectrometer configured of four rod electrodes. However, the mass spectrometry unit 4 may be a multipole mass spectrometer configured of four or more rod electrodes and may be a quadrupole ion trap type mass spectrometer. In addition, as illustrated in FIG. 1, when the longitudinal direction of the rod electrodes is set as a z direction, and the cross-sectional direction is set to an x-y plane, as illustrated in the x-y cross-sectional view of the rod electrodes, the four rod electrodes may be cylinder electrodes or may be a rod electrode having a bipolar surface shape as indicated by a dashed line.

In such four rod electrodes, by setting two electrodes facing each other as a set, voltages of opposite phases +(U+V cos Ωt) and −(U+V cos Ωt) are applied to two sets of electrodes 13*a* and 13*b*. As illustrated in Expression (1), a radio frequency electric field Ex, Ey is generated between the four rod electrodes.

[Math 1]

$$E_x = -\frac{\partial \Phi}{\partial x} = -\frac{2(U + V\cos\Omega t)}{r_0^2} \cdot x, \qquad (1)$$

$$E_y = -\frac{\partial \Phi}{\partial y} = +\frac{2(U + V\cos\Omega t)}{r_0^2} \cdot y$$

The ionized sample ion is introduced along a central axis (z direction) between the rod electrodes, and passes through the radio frequency electric field of Expression (1). At this time, the stability of ion trajectories in x and y directions is determined by the following non-dimensional parameters a and q obtained from an equation of motion (Mathieu equation) of ions between the rod electrodes.

[Math 2]

$$a = \frac{8eU}{\Omega^2 m r_0^2} \tag{2}$$

[Math 3]

$$q = \frac{4eV}{\Omega^2 m r_0^2} \tag{3}$$

Here, valence z is set to 1. In a case of z≠1, in Expression (2) and Expression (3), $r_0$ is a half value of the distance between the facing rod electrodes, e is the elementary charge, m is mass of an ion, U is a direct current voltage applied to the rod electrode, V and Ω are an amplitude and an angular frequency of a radio-frequency voltage. If the values of $r_0$, U, V, and Ω are determined, each ion species corresponds to a different point (a, q) on an a-q plane depending on the number of mass m of the ion species. At this time, from Expression (2) and Expression (3), all of the different points (a, q) of the ion species exist on a straight line of Expression (4).

[Math 4]

$$a = \frac{2U}{V} q \tag{4}$$

FIG. 3 illustrates a quantitative range (stable transmission region) of a and q, which gives a stable solution, with respect to the ion trajectories in the x and y directions in the mass spectrometer system of the present embodiment. In order to perform mass-separation by passing only the ion species having a specific mass number M through the rod electrodes, and causing other ion species to be unstably emitted, it is necessary to adjust the ratio of U and V so that the ratio intersects the vicinity of the apex of the stable transmission region in FIG. 3.

FIG. 4 illustrates a conceptual diagram in which only an ion having a target mass number m passes through the rod electrodes, and adjacent ions are unstable. The ion, which is stably transmitted, passes through the rod electrodes 13 in the z direction while vibrating. In contrast, the vibration of the unstable ion is increased so that the unstable ion is emitted in the x and y directions. The straight line of Expression (4) is called a mass scanning line, and by sequentially scanning the values of U and V while maintaining the inclination (U/V ratio) of the mass scanning line, the mass number M of the ion species, which is stably transmitted between the rod electrodes and mass-separated, is scanned.

[Math 5]

$$U = \frac{m r_0^2 \Omega^2}{8e} a \tag{5}$$

[Math 6]

$$V = \frac{m r_0^2 \Omega^2}{4e} q \tag{6}$$

At this time, from Expression (5) and Expression (6) which are modified from Expression (2) and Expression (3), usually, the mass number M of the ion species is scanned by increasing the values of U and V in proportion to the ion mass m.

FIG. 5 illustrates a control method of a voltage at this time. In addition, FIG. 6 illustrates a case in which the angular frequency Ω or a frequency f of the radio-frequency voltage is change-controlled according to the mass number of the ion species to be mass-selected and separated based on Expression (7).

[Math 7]

$$\Omega = 2\pi f = \sqrt{\frac{4eV}{m r_0^2 q}} = \sqrt{\frac{8eU}{m r_0^2 a}} \tag{7}$$

In the mass spectrometer system of the present embodiment, by scanning the mass number M or the mass-to-charge ratio m/z of the ion species to be mass-selected and separated according to the scanning method illustrated in FIG. 5 or 6, finally, the results of measuring the number of detections of all of the ions in the sample for each mass number M are output as the mass spectrum as illustrated in (1) of FIG. 7. Based on these results, a user can perform qualitative analysis in which a component in the sample is specified or quantitative analysis in which the amount of each component is measured.

As illustrated in (1) of FIG. 7, the mass spectrum is configured of the distribution of the number of detections (mass peak) for each mass number, and the area of the mass peak corresponds to the amount of the ion species of a mass M. Accordingly, as illustrated in (2) of FIG. 7, if the mass peak of the mass number M overlaps the mass peak of the ion species of the adjacent mass number M±1 (adjacent ion), the accuracy of the measured amount of each component is decreased. In the quantitative analysis, as illustrated in (1) of FIG. 7, each mass peak is required to be separated from the mass peak of the adjacent ion with high separability (high resolution). As an index of the high resolution, the half value width of each mass peak ΔM is required to satisfy at least ΔM<0.5. In the mass spectrometer system in the related art, there is a tendency that the mass spectrum overlaps the mass peak of the adjacent ion as the mass number m is increased, and the resolution is degraded.

As illustrated in FIG. 4, the ion is injected into the rod electrodes, and the ion passes through the radio frequency electric field between the rod electrodes while vibrating. At this time, it is known that, as the number of vibrations N that the ion vibrates becomes larger, the half value width ΔM of the mass peak is decreased, and thus the resolution is improved. In addition, the number of vibrations N of an ion is approximately proportional to the angular frequency Ω or the frequency f (=Ω/(2π)) of the radio-frequency voltage V cos Ωt that is applied to the rod electrodes. Accordingly, by setting the angular frequency Ω of the radio-frequency voltage V cos Ωt to be increased as the mass-to-charge ratio m/z becomes larger, it is possible to increase the number of vibrations N that the ion vibrates when the ion passes through the rod electrodes as the mass-to-charge ratio m/z of the ion becomes larger, and the resolution is expected to be improved. Accordingly, the angular frequency Ω is set to be increased according to the mass-to-charge ratio m/z as illustrated in Expression (8).

[Math 8]

$$\Omega \propto (m/z)^x (z>0) \tag{8}$$

However, in the quadrupole mass spectrometer, it is required to satisfy Expression (5) and Expression (6) in order to perform mass-selection and separation. Thus, the relationship of Expression (8) is expressed by Expression (9) by using a constant C. At this time, Expression (5) and Expression (6) are modified to the following Expression (10) and Expression (11).

[Math 9]

$$\Omega = C \cdot (m/z)^x (x > 0) \tag{9}$$

[Math 10]

$$U = a \cdot C^2 \cdot \frac{m^{(2x+1)} r_0^2}{8e} (x > 0) \tag{10}$$

[Math 11]

$$V = q \cdot C^2 \cdot \frac{m^{(2x+1)} r_0^2}{4e} (x > 0) \tag{11}$$

In the mass spectrometer system of the present embodiment, as illustrated in a scanning method 12 of FIG. 8, in a case where the mass-to-charge ratio m/z to be mass-selected and separated or the mass number M (at the time of valence z=1) of the ion species is scanned so that the m/z value (or M) is increased by using Expression (9), Expression (10), and Expression (11), the scanning is performed so that the direct current voltage U, the amplitude V and the angular frequency Ω of the radio-frequency voltage V cos Ωt are simultaneously increased. However, from Expression (10) and Expression (11), in a case of x≥1, since the values of U and V are rapidly increased according to m/z, 0<x<1 is preferable, and 0<x<½ is more preferable. At this time, since the number of vibrations N that the ion vibrates when the ion passes through the rod electrodes is proportional to the angular vibration frequency Ω of the radio-frequency voltage V cos Ωt, the ion frequency is increased as the m/z becomes larger, which results in the improvement of the resolution.

A conceptual diagram of the mass spectrum obtained at this time is illustrated in (1) and (2) of FIG. 9. As described above, by the mass spectrometer system and the spectrometry method of the present embodiment, in not only the low mass number ions but also in the high mass number ions, ΔM is decreased and the resolution can be improved as illustrated in (2) of FIG. 9.

Second Embodiment

Next, a second embodiment will be described by using FIGS. 10, 11A, 11B, 12, 13A, and 13B. FIG. 10 is a diagram illustrating a control method of an application voltage of the mass spectrometry unit, which is a characteristic of the second embodiment. In the embodiment, in order to increase the number of vibrations N of the ion when the ion passes through the rod electrodes while vibrating after the ion having a large mass-to-charge ratio m/z is injected into the rod electrodes, an ion injection unit 14 is provided. Here, injection energy of the ion that is injected into the mass spectrometry unit 4 is controlled. At this time, as illustrated by a control method 15 of FIG. 11A, the control unit 8 performs control so that the injection energy of the ion is applied according to the mass-to-charge ratio m/z of the ion based on the following relational expression.

[Math 12]

$$E \propto \frac{1}{(m/z)^x} (x > 0) \tag{12}$$

That is, as the mass number of an ion becomes higher, the injection energy is decreased and the injection speed is decreased. Therefore, it is expected that the time for which the ion passes through the rod electrodes is increased and the ion frequency N is increased. Accordingly, in the present embodiment, high resolution is expected for the mass spectrum of the high mass number ion. Here, as a control method of the injection energy of the ion, the energy may be changed similar to the step function as described in the control method 15 of FIG. 11B.

In addition, as illustrated in FIG. 12, as a specific configuration of the ion injection unit 14, the ion injection unit is configured of two or more of electrode 16*a* and 16*b* in which an opening of which the ion can pass through the center is provided, the voltages applied to the electrodes are V1 and V2. As illustrated in FIGS. 13A and 13B, the control unit 8 controls by using a control method 16 so that the potential difference ΔV=V1−V2 is changed according to the mass-to-charge ratio m/z of the ion based on the following expression.

[Math 13]

$$\Delta V \propto \frac{1}{(m/z)^x} (x > 0) \tag{13}$$

In this case, as the mass number of an ion becomes higher, the injection energy is decreased and the injection speed is decreased. Therefore, the time for which the ion passes through the rod electrodes is increased and the ion frequency N of an ion is increased. Accordingly, the same effects as those illustrated in FIGS. 10, 11A, and 11B, that is, high resolution for the mass spectrum of the high mass number ion is expected. Instead of the ion injection unit 14, the ion transport unit 3 may be used. In the present embodiment, from Expression (12) and Expression (13), in a case of x≥1, since the values of E and ΔV are rapidly increased according to m/z, 0<x<1 is preferable, and x<½ is more preferable.

Third Embodiment

Next, a third embodiment will be described by using FIGS. 14, 15, 16, and 17. As illustrated in FIG. 14, in the mass spectrometer system of the present embodiment, ion reflection units 17*a* and 17*b*, which are configured of ion reflection electrodes 18*a* and 18*b*, are provided at both end portions of the rod electrodes. A control method 19 of a voltage applied to the ion reflection electrodes 18*a* and 18*b* is illustrated in FIGS. 16 and 17. Here, as illustrated in FIG. 16, by applying a voltage to the ion reflection electrode, the ion species having a specific m/z value or higher is controlled so that, when the ion reaches the end portion of the rod electrodes, the ion species is reflected without being emitted from the rod electrodes and passes through the rod electrodes again.

FIG. 15 illustrates the overview of the phenomenon at this time. As illustrated in FIG. 17, as the control method of the mass spectrometry (mass number scanning method), if the spectrometry is performed by making the value of the mass-to-charge ratio m/z of the target ion species for spectrometry proportional to time, the spectrometry-allocation time for each ion species (Mi) is ΔT(Mi). Accordingly, as illustrated in FIG. 16, the reflection voltage application time ΔT(Vref) is controlled to match the timing of ion mass scanning so that ΔT(Vref)<ΔT(Mi). Here, the reason for the control so that ΔT(Vref)<ΔT(Mi) is that, since the ion is injected into or emitted from the rod electrodes, it is necessary to provide time for which the reflection voltage is not applied. However, as a scanning method of a target for mass spectrometry (m/z), even if the linear scanning method relative to time as illustrated in FIG. 17 is not used, any scanning method can be used as long as controlling is performed so that ΔT(Vref)<ΔT(Mi).

In addition, since a voltage for reflecting the ion again is applied to the end side where the ion is injected into the rod electrode, the reflection voltage is caused to be zero (|Vref|=0) until the spectrometry-allocation time for the next ion species so that the ion passes through the rod electrodes by one and half reciprocation to be emitted to the side where the detector 5 is provided. However, the symbol of Vref is negative in a case of a negative ion, and is positive in a case of a positive ion, and the absolute value |Vref| is greater than ΔV when the injection energy Einj of the ion is applied. At this time, the number of reciprocation of the ion between the rod electrodes by being reflected may be 3n/2 (integer of n≥1). That is, according to the embodiment, since the number of vibrations of the ion when the ion passes through the rod electrodes is increased for the ion species having a large mass-to-charge ratio m/z, it is possible to improve the resolution.

Fourth Embodiment

Next, a mass spectrometer system of a fourth embodiment will be described by using FIG. 18. As illustrated in FIG. 18, in a connection type mass spectrometry unit 20 in which at least two sets or more, preferably, three sets of four or more rod electrodes are connected in the longitudinal direction, a voltage that is controlled by a mass adjusting method illustrated in FIG. 18 is applied to at least one set of the rod electrodes. For example, in a case where two sets of the rod electrodes are provided, not the direct current voltage (DC voltage), but only the radio-frequency voltage (V cos Ωt) is applied to the first set of the rod electrodes, and the direct current voltage (DC voltage) and the radio-frequency voltage (V cos Ωt) are applied to the second set of the rod electrodes based on a control method 12 illustrated in FIG. 18, so that the number of vibrations when the ion passes through may be increased as the mass number of an ion becomes higher. At this time, in the first set of the rod electrodes, since the ion corresponds to a point on a a=0 line of the stable transmission region illustrated in FIG. 3, there is an effect in which the ion stably passes through the first set of the rod electrodes and is injected into the second set of the rod electrodes. Meanwhile, in a case where three sets of the rod electrodes are provided, in the first set of the rod electrodes, the direct current voltage (DC voltage) and the radio-frequency voltage (V cos Ωt) are applied based on a control method illustrated in FIG. 18, the mass number is set in the vicinity of the apex of the stable transmission region, and only a specific ion species is separated to pass through the first set of the rod electrodes; in the second set of the rod electrodes, filling of a neutral gas or the like is made, the specific ion species (precursor ion) that has passed through the first set of rod electrodes is caused to collide with the neutral gas to be fragmented (Collision Induced Dissociation); in the third set of rod electrodes, based on the control method illustrated in FIG. 18, further, a direct current voltage (DC voltage) and a radio-frequency voltage (V cos Ωt) are applied, and the mass spectrometry of the fragment ion is performed. At this time, since the number of vibrations of the precursor ion and the number of vibrations of the fragment ion when the ions pass through the rod electrodes are increased as the value of the mass-to-charge ratio m/z becomes large, the resolution is expected to be improved.

In addition, the invention is not limited to the embodiments described above, and includes various modification examples. For example, the embodiments described above have been described in detail for easier understanding of the invention, and the invention is not limited to those essentially including all the described configurations. In addition, a part of the configuration in any embodiment can be replaced with the configuration in another embodiment, and the configuration in any embodiment can be added with the configuration from another embodiment. Further, for a part of the configuration of each embodiment, addition, removal, and replacement of other configurations can be made.

The configurations, functions, and process units described above are described by exemplifying a case of creating a program executed by the data processing unit or the control unit, which implement a part or all of the configurations, functions, and process units. However, it is needless to say that a part or all of the configurations, functions, and process units may be implemented as hardware by design as the integrated circuit, for example.

REFERENCE SIGNS LIST

1 PREPROCESS SYSTEM
2 IONIZATION UNIT
3 ION TRANSPORT UNIT
4 MASS SPECTROMETRY UNIT
5 ION DETECTING UNIT
6 DATA PROCESSING UNIT
7 DISPLAY UNIT
8 CONTROL UNIT
9 VOLTAGE SOURCE
10 USER INPUT UNIT
11 ENTIRE MASS SPECTROMETER SYSTEM
12 APPLICATION VOLTAGE CONTROL UNIT
13, 13*a*, 13*b*, 13*c*, 13*d* ROD ELECTRODES
14 ION INJECTION UNIT
15 CONTROL METHOD OF INJECTION ENERGY
16 CONTROL METHOD OF INJECTION VOLTAGE
17*a*, 17*b* ION REFLECTION UNIT
18*a*, 18*b* ION REFLECTION ELECTRODE
19 ION REFLECTION VOLTAGE CONTROL METHOD
20 TANDEM MASS SPECTROMETER SYSTEM

The invention claimed is:

1. A mass spectrometer system, comprising:

a mass spectrometry unit that performs mass selection and separation of an ion species by applying a direct current voltage U and a radio-frequency voltage (V cos Ωt) to a multipole electrode to generate a multipole electric field, injecting an ionized sample thereinto, and adjusting and controlling the direct current voltage and the radio-frequency voltage applied to the multipole electrode so that the ion species having a specific mass-to-charge ratio m/z is allowed to pass through the multipole electrode;

an ion detecting unit that detects the ion species;

a data processing unit that processes an output of the ion detecting unit; and a control unit that controls the mass spectrometry unit, wherein V is an amplitude V of the radio-frequency voltage, Ω is an angular frequency of the radio-frequency voltage, and t is time;

wherein based on a value of the mass-to-charge ratio m/z of the ion species that is allowed to pass through the multipole electrode, the control unit controls the direct current voltage and the radio-frequency voltage applied by the mass spectrometry unit to the multipole electrode so as to set an ion frequency of the ion species in proportion to the value of the mass-to-charge ratio m/z of the ion species allowed to pass through the multipole electrode;

wherein the ion frequency is a number of oscillations when the ion species passes through the multipole electrode; and wherein the control unit controls values of the direct current voltage U, the amplitude V of the radio-frequency voltage, and the angular frequency Ω of the radio-frequency voltage, which are applied to the multipole electrode, to be increased at the same time, when the value of the mass-to-charge ratio m/z of a mass selection-separation target ion to be scanned is increased and to be decreased at the same time, when the value of the mass-to-charge ratio m/z of a mass selection-separation target ion to be scanned is decreased.

2. The mass spectrometer system according to claim 1, wherein the control unit controls the values of the direct current voltage U and the amplitude V of the radio-frequency voltage, which are applied to the multipole electrode, to be proportional to the mass-to-charge ratio (m/z) raised to the power of x (x>1) in order to scan the value of the mass-to-charge ratio m/z of the mass selection-separation target ion.

3. The mass spectrometer system according to claim 1, wherein the control unit controls the value of the angular frequency Ω of the radio-frequency voltage, which is applied to the multipole electrode, to be proportional to the mass-to-charge ratio (m/z) raised to the power of x (x≥½) in order to scan the value of the mass-to-charge ratio m/z of the mass selection-separation target ion.

4. The mass spectrometer system according to claim 1, wherein the control unit controls, in order to scan the value of the mass-to-charge ratio m/z of a mass selection-separation target ion, injection energy E when the ionized sample is injected into the multipole electrode so that the injection energy E is decreased as the value of the mass-to-charge ratio m/z of the mass selection-separation target ion becomes larger, and the injection energy E is increased as the value of the mass-to-charge ratio m/z of the mass selection-separation target ion becomes smaller.

5. The mass spectrometer system according to claim 4, wherein the control unit controls, in order to scan the value of the mass-to-charge ratio m/z of the mass selection-separation target ion, the injection energy E when the ionized sample is injected into the multipole electrode to be inversely proportional to the value of the mass-to-charge ratio m/z.

6. The mass spectrometer system according to claim 1, further comprising:

ion reflecting units that are provided at end portions of the mass spectrometry unit, wherein the control unit controls, in order to scan the value of the mass-to-charge ratio m/z of a mass selection-separation target ion, an ion having a high m/z value that is equal to or greater than a specific mass-to-charge ratio so that a voltage for reflecting the ion species is applied to the ion reflecting unit, which is provided at the end portion opposite to the end portion where the ion species is injected into the multipole electrode of the mass spectrometry unit, and the ion species is reflected without being emitted from the multipole electrode to pass through the multipole electrode again.

7. The mass spectrometer system according to claim 6, wherein the control unit performs control so that the voltage for reflecting the ion species again to the ion reflecting unit provided at the end portion where the ion species is injected into the multipole electrode of the mass spectrometry unit is applied, and the ion species is emitted to the ion detecting unit after the ion species passes through the multipole electrode by 3n/2 reciprocation (integer of n≥1).

8. The mass spectrometer system according to claim 1, wherein the control unit controls the value of the mass-to-charge ratio m/z of a mass selection-separation target ion to be scanned.

9. The mass spectrometer system according to claim 1, wherein the mass spectrometry unit is configured of a tandem mass spectrometry unit in which a plurality of the multipole electrodes are arranged in a longitudinal direction, and wherein the control unit performs control so that at least one of the plurality of multipole electrodes scans the value of the mass-to-charge ratio m/z of a mass selection-separation target ion.

10. A mass spectrometry method using a mass spectrometry unit, the method comprising:

controlling the mass spectrometry unit so that mass selection and separation of an ion species is performed by applying a direct current voltage and a radiofrequency voltage to a multipole electrode of the mass spectrometry unit to generate a multipole electric field, injecting an ionized sample thereinto, and adjusting and controlling the direct current voltage and the radio-frequency voltage applied to the multipole electrode so that the ion species having a specific mass-to-charge ratio m/z is allowed to pass through the multipole electrode, and when the ion species is detected, based on a value of the mass-to-charge ratio m/z of the ion species that is allowed to pass through the multipole electrode, controlling the direct current voltage and the radio-frequency voltage applied to the multipole electrode so as to set an ion frequency of the ion species in proportion to the value of the mass-to-charge ratio m/z of the ion species allowed to pass through the multipole electrode;

wherein the ion frequency is a number of oscillations when the ion species passes through the multipole electrode: and wherein values of the direct current voltage, an amplitude of the radio-frequency voltage, and an angular frequency of the radio-frequency voltage, which are applied to the multipole electrode, are controlled by the controller to be increased at the same time, when the value of the mass-to-charge ratio m/z of a mass selection-separation target ion to be scanned is increased and to be decreased at the same time, when the value of the mass-to-charge ratio m/z of a mass selection-separation target ion to be scanned is decreased.

11. The mass spectrometry method according to claim 10, wherein, in order to scan the value of the mass-to-charge ratio m/z of the mass selection-separation target ion, the values of the direct current voltage and the amplitude of the radio-frequency voltage, which are applied to the multipole electrode, or the value of the angular frequency of the radio-frequency voltage, which is applied to the multipole electrode, is controlled to be proportional to the mass-to-charge ratio m/z raised to the power of x.

12. The mass spectrometry method according to claim 10, wherein, in order to scan the value of the mass-to-charge ratio m/z of a mass selection-separation target ion, injection energy when the ionized sample is injected into the multipole electrode is controlled so that the injection energy is decreased as the value of the mass-to-charge ratio m/z of the mass selection-separation target ion becomes larger, or the injection energy is increased as the value of the mass-to-charge ratio m/z of the mass selection-separation target ion becomes smaller.

13. The mass spectrometry method according to claim 10, wherein the mass spectrometry unit includes ion reflecting units at end portions thereof, and wherein, in order to scan the value of the mass-to-charge ratio m/z of a mass selection-separation target ion, an ion having a high m/z value that is equal to or greater than a specific mass-to-charge ratio is controlled so that a voltage for reflecting the ion species is applied to the ion reflecting unit, which is provided at the end portion opposite to the end portion where the ion species is injected into the multipole electrode of the mass spectrometry unit, and the ion species is reflected without being emitted from the multipole electrode to pass through the multipole electrode again.

14. The mass spectrometer method according to claim 12, further comprising:

in order to scan the value of the mass-to-charge ratio m/z of the mass selection-separation target ion, controlling the injection energy E when the ionized sample is injected into the multipole electrode to be inversely proportional to the value of the mass-to-charge ratio m/z.

15. The mass spectrometer method according to claim 13, further comprising:

controlling the mass spectrometry unit so that the voltage for reflecting the ion species again to the ion reflecting unit provided at the end portion where the ion species is injected into the multipole electrode of the mass spectrometry unit is applied, and the ion species is emitted to the ion detecting unit after the ion species passes through the multipole electrode by 3n/2 reciprocation (integer of $n \geq 1$).

16. The mass spectrometer method according to claim 10, further comprising:

controlling the value of the mass-to-charge ratio m/z of a mass selection-separation target ion to be scanned.

17. The mass spectrometer method according to claim 10, further comprising:

configuring the mass spectrometry unit as a tandem mass spectrometry unit in which a plurality of the multipole electrodes are arranged in a longitudinal direction, and controlling the mass spectrometry unit so that at least one of the plurality of multipole electrodes scans the value of the mass-to-charge ratio m/z of a mass selection-separation target ion.

* * * * *